US011252505B2

(12) United States Patent
Tu et al.

(10) Patent No.: US 11,252,505 B2
(45) Date of Patent: Feb. 15, 2022

(54) METHOD FOR REGULATING SOUND SOURCE OF DESIGNATED OBJECT AND AUDIO PROCESSING DEVICE USING SAME

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW); Chao-Kuang Yang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/152,576

(22) Filed: Jan. 19, 2021

(65) Prior Publication Data

US 2021/0250682 A1 Aug. 12, 2021

(30) Foreign Application Priority Data

Feb. 12, 2020 (TW) ..... 109104422

(51) Int. Cl.
*H04R 3/00* (2006.01)
*H04R 1/40* (2006.01)
(Continued)

(52) U.S. Cl.
CPC ..... *H04R 3/005* (2013.01); *H04R 1/406* (2013.01); *H04R 5/04* (2013.01)

(58) Field of Classification Search
CPC ..... H04R 3/005; H04R 1/406; H04R 5/04; H04S 2420/01; H04S 2400/15; H04S 2400/13
(Continued)

(56) References Cited

U.S. PATENT DOCUMENTS 5,687,239 A * 11/1997 Inanaga ..... H04S 7/304 381/309
5,717,767 A * 2/1998 Inanaga ..... H04R 1/1041 381/17
(Continued)

FOREIGN PATENT DOCUMENTS

CN 109074238 A 12/2018
CN 109314568 A 2/2019
TW 201503110 A 1/2015

*Primary Examiner* — Thjuan K Addy
(74) *Attorney, Agent, or Firm* — Birch, Stewart, Kolasch & Birch, LLP

(57) ABSTRACT

A method for regulating a sound source of a designated object and an audio processing device using same are provided. The method includes the following steps. An original two-channel signal is obtained. An included angle of the designated object with respect to an ear of a user is detected. A first beam and a second beam are respectively formed in a clockwise direction and a counterclockwise direction according to the included angle to obtain a bidirectional sound signal. A sound rotation process is performed, so that the ear is directed toward sound source of the designated object, and a rotated two-channel sound signal is obtained. A unidirectional sound signal towards the sound source is obtained. A sound signal characteristic of the designated object is obtained according to the bidirectional sound signal and the unidirectional sound signal and then is regulated to synthesize a regulated two-channel signal.

20 Claims, 6 Drawing Sheets

(51) Int. Cl.
*H04R 5/04* (2006.01)
*H04S 7/00* (2006.01)

(58) Field of Classification Search
USPC ..... 381/92, 94.1, 93, 94.7, 94.8, 94.5
See application file for complete search history.

(56) References Cited

U.S. PATENT DOCUMENTS

| | | | |
|---|---|---|---|
| 2006/0256974 | A1 | 11/2006 | Oxford |
| 2018/0078144 | A1 | 3/2018 | Schmid |

* cited by examiner

METHOD FOR REGULATING SOUND SOURCE OF DESIGNATED OBJECT AND AUDIO PROCESSING DEVICE USING SAME

This application claims the benefit of Taiwan application Serial No. 109104422, filed Feb. 12, 2020, the subject matter of which is incorporated herein by reference.

BACKGROUND OF THE INVENTION

Field of the Invention

The invention relates in general to a method and a processing device using same, and more particularly to a method for regulating a sound source of a designated object and an audio processing device using same.

Description of the Related Art

When a user plays games or watches movies, the two-channel signal of the games or movies possesses a three-dimensional spatial characteristic. After the user designates a particular object (role or article) on the screen, the user may wish to suitably regulate the sound signal according to the needs. For example, the user may wish to reduce the sound of an exhaust pipe, increase the sound of a monster or even change the sound style of his/her teammate.

Normally, only game/movie manufacturers can regulate the sound source. The audio processing device only has synthesized two-channel signal. Once the two-channel signal is regulated, all sound sources are changed accordingly, and other sound sources may be distorted.

Therefore, it has become a prominent task for the industries to provide a method for regulating a sound source of a designated object.

SUMMARY OF THE INVENTION

The invention is directed to a method for regulating a sound source of a designated object and an audio processing device using the same capable of obtaining a sound signal characteristic of a sound source of a designated object using a beamforming technique, a sound rotation technique and an end fire array technique to regulate the sound source.

According to a first aspect of the present invention, an audio processing device is provided. The audio processing device is used to regulate a sound source of a designated object. The audio processing device includes a signal reception unit, an angle detection unit, a beamforming unit, a rotation unit, an end fire array a signal processing unit and a regulation unit. The signal reception unit is used to receive an original two-channel signal. The angle detection unit is used to detect an included angle of the designated object with respect to an ear of a user. The beamforming unit is used to respectively form a first beam and a second beam in a clockwise direction and a counterclockwise direction according to the included angle to obtain a bidirectional sound signal. The rotation unit is used to perform a sound rotation process, so that the ear is directed toward sound source of the designated object, and a rotated two-channel sound signal is obtained. The end fire array is used to obtain a unidirectional sound signal towards the sound source of the designated object. The unidirectional sound signal contains a noise. The signal processing unit is used to obtain a sound signal characteristic of the designated object according to the bidirectional sound signal and the unidirectional sound signal. The regulation unit is used to regulate the sound signal characteristic of the designated object to synthesize a regulated two-channel signal.

According to a second aspect of the present invention, a method for regulating a sound source of a designated object is provided. The method includes the following steps. An original two-channel signal is obtained. An included angle of the designated object with respect to an ear of a user is detected. A first beam and a second beam are respectively formed in a clockwise direction and a counterclockwise direction according to the included angle to obtain a bidirectional sound signal. A sound rotation process is performed, so that the ear is directed toward sound source of the designated object, and a rotated two-channel sound signal is obtained. A unidirectional sound signal towards the sound source of the designated object is obtained. The unidirectional sound signal contains a noise. A sound signal characteristic of the sound source of the designated object is obtained according to the bidirectional sound signal and the unidirectional sound signal. The sound signal characteristic of the sound source of the designated object is regulated to synthesize a regulated two-channel signal.

An original two-channel signal is obtained. An included angle of a designated object with respect to an ear of a user is detected. A first beam and a second beam are respectively formed in a clockwise direction and an anti-clockwise direction according to the included angle to obtain a bidirectional sound signal. A sound rotation process is performed, so that the ear is directed toward a sound source of a designated object, and a rotated two-channel sound signal is obtained. A unidirectional sound signal towards the sound source is obtained. The unidirectional sound signal contains a noise. A sound signal characteristic of the designated object is obtained according to the bidirectional sound signal and the unidirectional sound signal. The sound signal characteristic of the designated object is regulated to synthesize a regulated two-channel signal.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
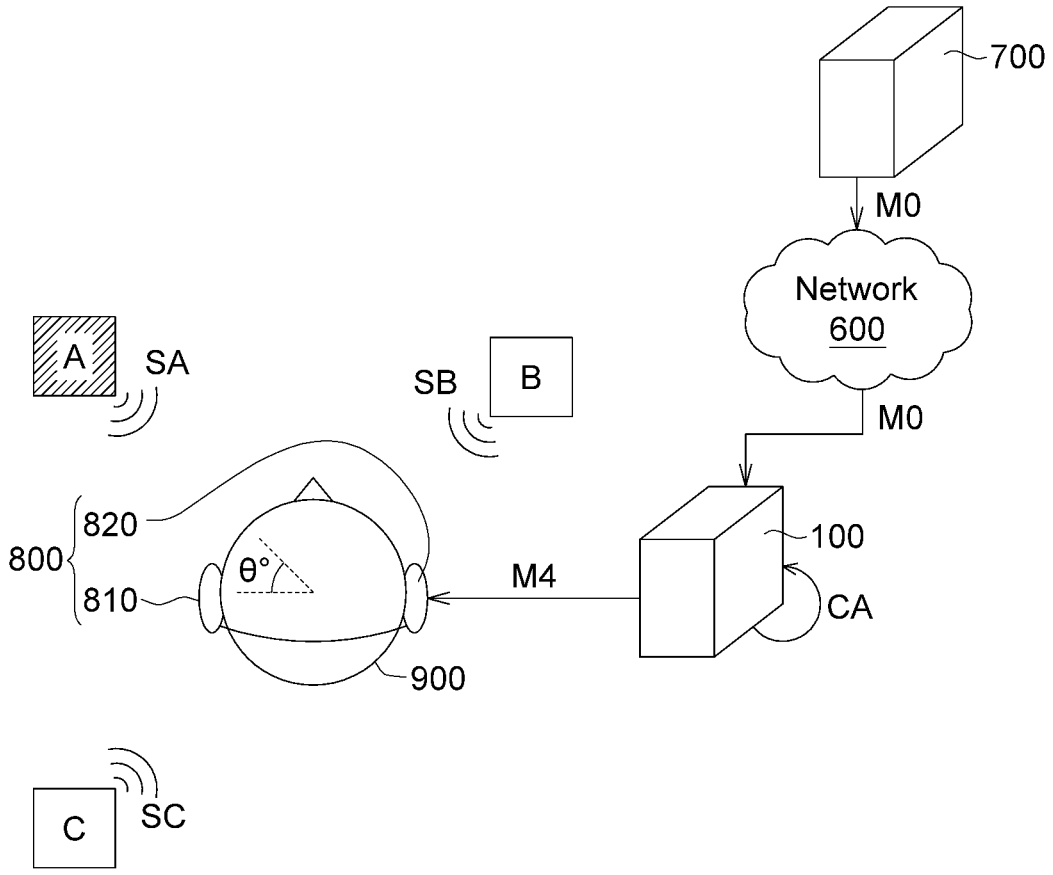
FIG. 1 is a schematic diagram of several sound sources according to an embodiment.

Referring to FIG. 1, a schematic diagram of several sound sources according to an embodiment is shown. The user 900 wears a headphone 800 on his/her two ears. The server 700 of the game/movie manufacturers adjusts the amplitude and phase using a HRTF technique to generate an original two-channel signal M0. After the original two-channel signal M0 is transmitted to the audio processing device 100 through the network 600, the original two-channel signal M0 is then transmitted to the left ear speaker 810 and the right ear speaker 820 of the headphone 800. When the user 900 listens to the original two-channel signal M0 using a left ear speaker 810 and a right ear speaker 820 of the headphone 800, the user can feel a sound source A, a sound source B and a sound source C at different positions. If the user regulates the sound source A, the sound source B and the sound source C will be distorted. In the present embodiment, a sound signal characteristic CA of the sound source A is obtained using a beamforming technique, a sound rotation technique and an end fire array technique, so that the sound source A can be regulated. After the sound source A is regulated, the audio processing device 100 can output a regulated two-channel signal M4.

In the present embodiment, a regulation mechanism for a sound source of a designated object is performed to the audio processing device 100 instead of the server 700 of the game/movie manufacturers, and therefore is not subjected to the source of the games/movies and can be used in various types of two-channel signals.

Figure 2:
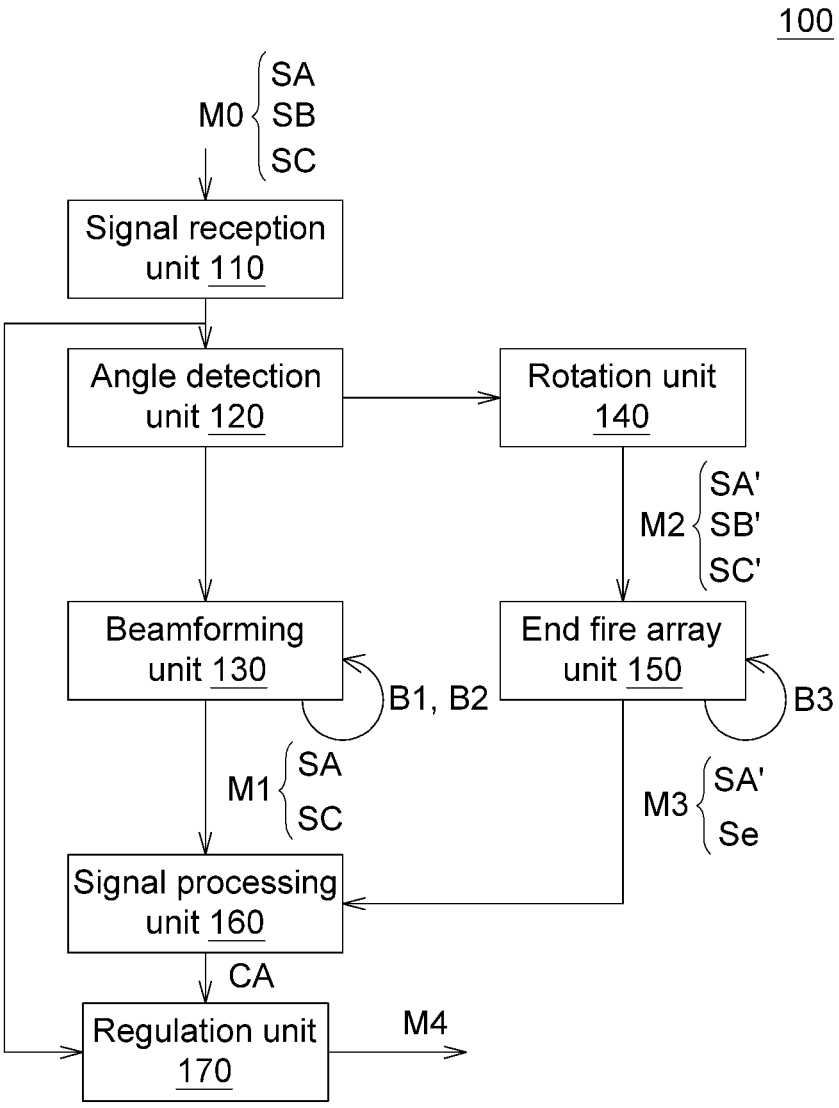
FIG. 2 is a schematic diagram of an audio processing device according to an embodiment.

Referring to FIG. 2, a schematic diagram of an audio processing device 100 according to an embodiment is shown. The audio processing device 100 can be realized by a computer, a mobile phone, a server, a circuit, a chip, a circuit board, an array code, or a storage device for storing programming codes. The audio processing device 100 includes a signal reception unit 110, an angle detection unit 120, a beamforming unit 130, a rotation unit 140, an end fire array 150, a signal processing unit 160, and a regulation unit 170. The signal reception unit 110 can be realized by a transmission line, a wireless transmission module, or a memory card reader. Each of the angle detection unit 120, the beamforming unit 130, the rotation unit 140, the end fire array 150, the signal processing unit 160 and the regulation unit 170 can be realized by a circuit, a chip, a circuit board, an array code, or a storage device for storing programming codes. Through the above elements, the audio processing device 100 obtains the sound signal characteristic CA of the sound source A from the original two-channel signal M0, so that the audio processing device 100 can regulate the sound source A according to the sound signal characteristic CA. Operations of the above elements are disclosed below with an accompanying flowchart.

Figure 3:
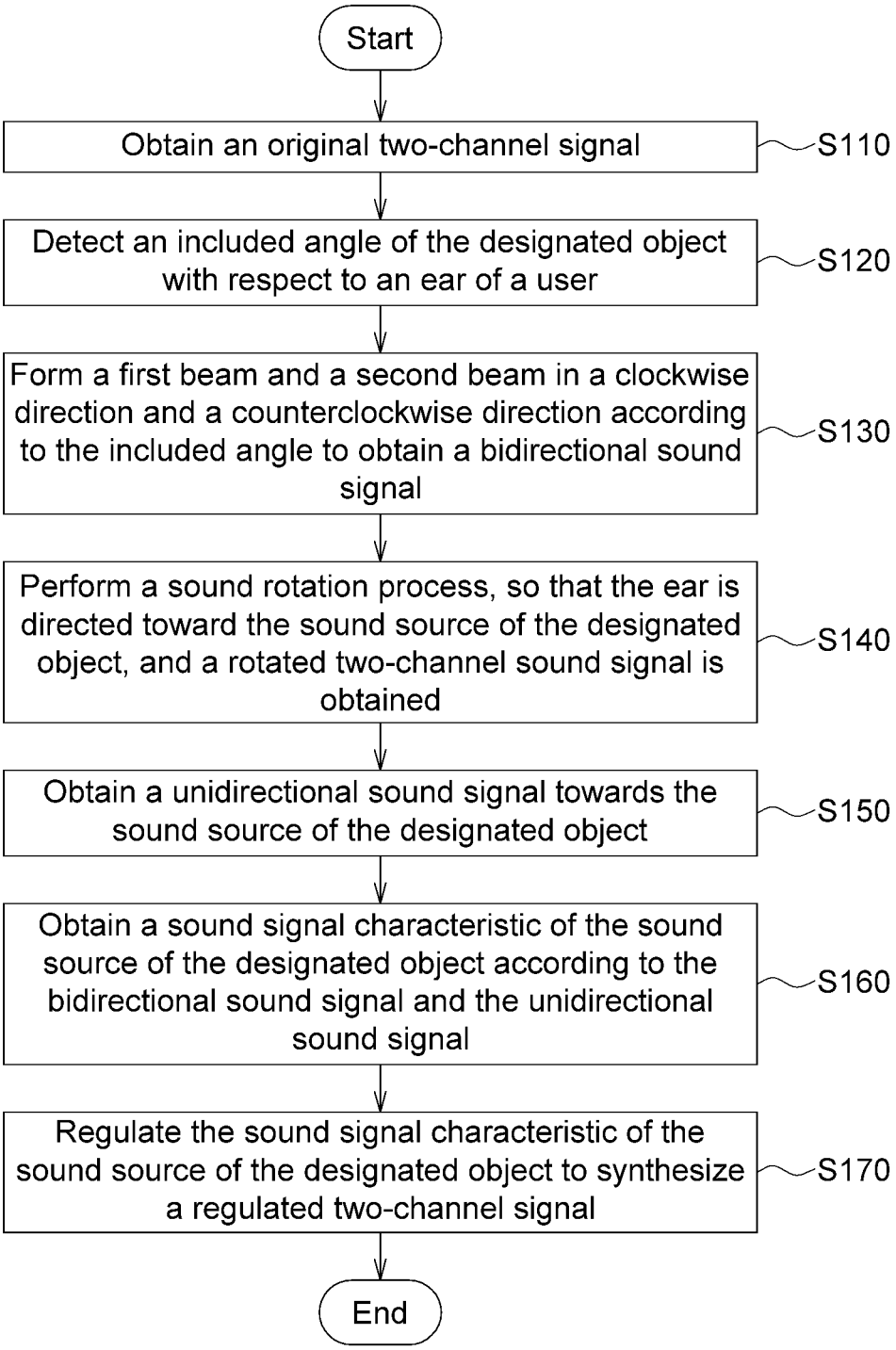
FIG. 3 is a flowchart of a method for regulating a sound source of a designated object according to an embodiment.

Referring to FIG. 3, a flowchart of a method for regulating a sound source of a designated object according to an embodiment is shown. In step S110, an original two-channel signal M0 is received by the signal reception unit 110. The original two-channel signal M0 contains a sound signal SA of the sound source A, a sound signal SB of the sound source B, and a sound signal SC of the sound source C. The original two-channel signal M0 is set to have a specific amplitude and a specific phase using the HRTF technique, so that the user 900 can feel the sound signal SA of the sound source A, the sound signal SB of the sound source B, and the sound signal SC of the sound source C.

Figure 4:
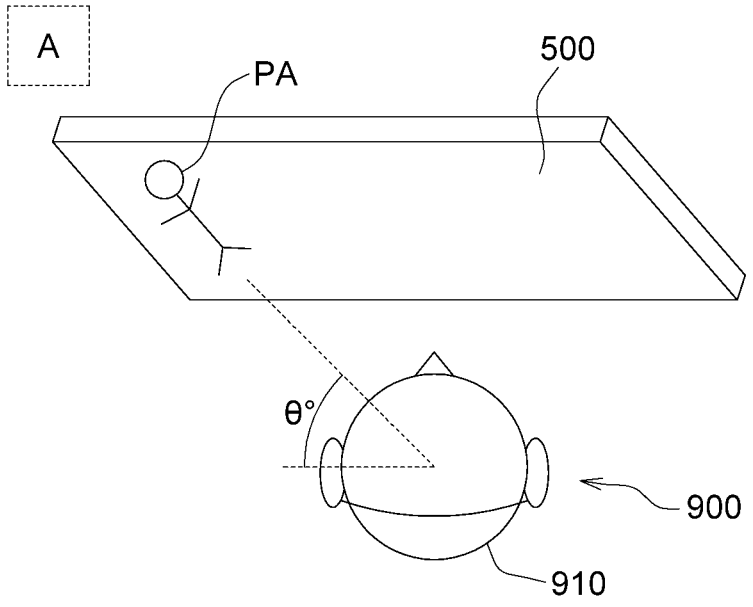
FIG. 4 is a schematic diagram of step S120 according to an embodiment.

Referring to FIG. 4, a schematic diagram of step S120 according to an embodiment is shown. In step S120, an included angle (such as θ°) of a designated object PA with respect to an ear (such as left ear) of the user 900 is detected by the angle detection unit 120. As indicated in FIG. 4, the angle detection unit 120 obtains the position of the designated object PA on the display 500 and the orientation of the head 910 using an image recognition technique to obtain the included angle.

Figure 5:
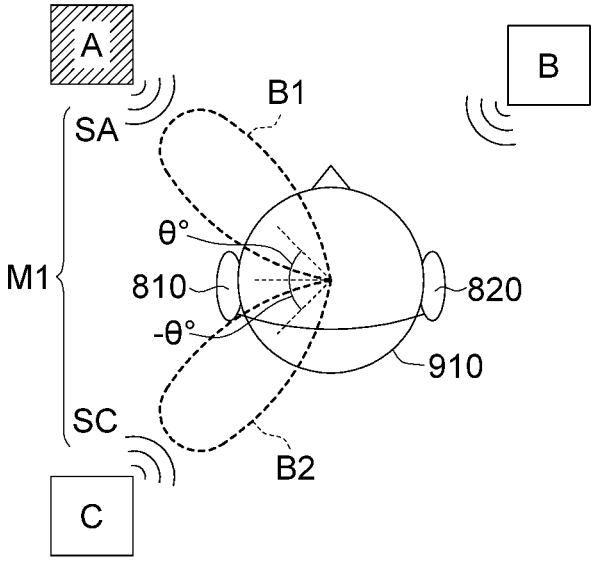
FIG. 5 is a schematic diagram of step S130 according to an embodiment.

Referring to FIG. 5, a schematic diagram of step S130 according to an embodiment is shown. In step S130, a first beam B1 and a second beam B2 are respectively formed in a clockwise direction and an anti-clockwise direction by the beamforming unit 130 according to the included angle to obtain a bidirectional sound signal M1. The left ear speaker 810 and the right ear speaker 820 can be regarded as two microphones separated by a width (about 17 cm) of the head 910. The beamforming unit 130 designates the direction of the beam as θ° through the adjustment of the phase. As indicated in FIG. 5, due to the features of the beamforming technique, whether the θ° beam is in a clockwise direction or an anti-clockwise direction cannot be determined, therefore the beamforming unit 130 respectively forms the first beam B1 and the second beam B2 having identical width in the θ° clockwise direction and the −θ° anti-clockwise direction, and further receives the sound signal SA of the sound source A and the sound signal SC of the sound source C.

Figure 6:
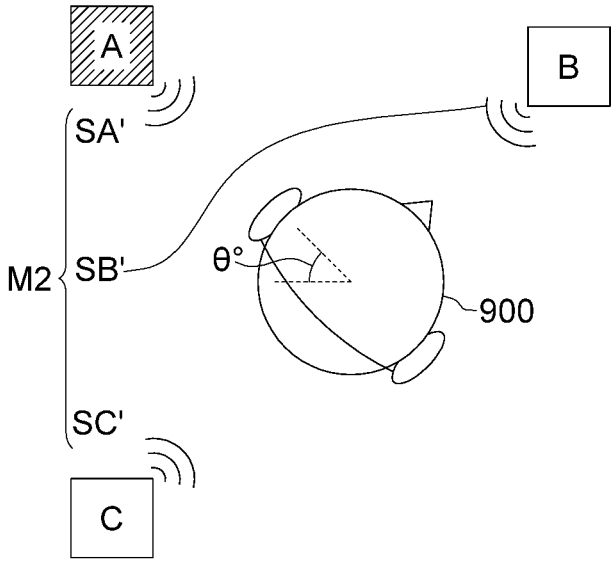
FIG. 6 is a schematic diagram of step S140 according to an embodiment.

Referring to FIG. 6, a schematic diagram of step S140 according to an embodiment is shown. The rotation unit 140*a* sound rotation process is performed, so that an ear (such as left ear) is directed toward sound source A, and a rotated two-channel sound signal M2 is obtained.

In the present step, the rotation unit 140, based on the HRTF technique, assumes that only the sound source A exists in the vicinity, the included angle of the sound source A with respect to the left ear is θ°, the included angle of the sound source A with respect to the right ear is 180-θ°, and each included angle is associated with an adjustment of a set of amplitude and phase. The rotation unit 140 rotates the head 910 by θ° and enables the sound source A to be directed towards the left ear, which is closer than the right ear, so that the included angle of the sound source A with respect to the left ear is 0° and the included angle of the sound source A with respect to the right ear is 180°. Meanwhile, there will be an adjustment of another set of amplitude and phase. As indicated in FIG. 5, the left-channel signal is converted to 0° from θ° and the right-channel signal is converted to 180° form 180-θ°. The above conversion only affects the direction of the sound source A but does not affect the sound source B and the sound source C in other directions. Meanwhile, the rotated two-channel sound signal M2 will contain the normally converted sound signal SA' of the sound source A and the abnormally converted sound signals SB' and SC' of the sound sources B and C. The sound source of the rotated two-channel sound signal M2 has a quantity identical to that of the sound source of the original two-channel signal M0.

Figure 7:
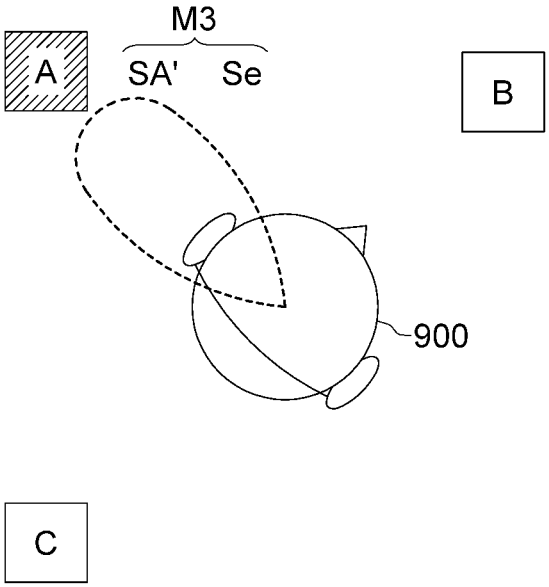
FIG. 7 is a schematic diagram of step S150 according to an embodiment.

Referring to FIG. 7, a schematic diagram of step S150 according to an embodiment is shown. In step S150, a unidirectional sound signal M3 towards the sound source A is obtained by the end fire array 150. With the end fire array technique, the end fire array 150 forms a third beam B3 which will be directed towards 0° or 180° only. As indicated in FIG. 7, the affected sound signals SB' and SC' are reduced. The third beam B3 has a width greater than that of the first beam B1 and the second beam B2. That is, the more interferences are received around the third beam B3, and the unidirectional sound signal M3 finally obtained contains a noise Se in addition to the sound signal SA'.

Figure 8:
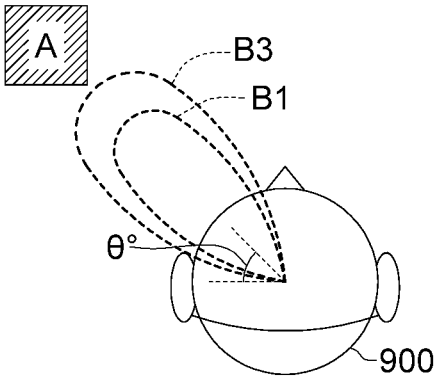
FIG. 8 is a schematic diagram of step S160 according to an embodiment.

Referring to FIG. 8, a schematic diagram of step S160 according to an embodiment is shown. In step S160, a sound signal characteristic CA of the sound source A is obtained by the signal processing unit 160 according to the bidirectional sound signal M1 and the unidirectional sound signal M3. In the present step, the signal processing unit 160 takes intersection of the bidirectional sound signal M1 and the unidirectional sound signal M3 to obtain the sound signal characteristic CA of the sound source A.

In step S170, the sound signal characteristic CA of the sound source A is regulated by the regulation unit 170 to synthesize a regulated two-channel signal M4. The sound signal characteristic CA outputted from the signal processing unit 160 will only contain signal characteristics of the sound source A and will not exactly match the original two-channel signal M0. The regulation unit 170 must regulate the phase and amplitude of the sound signal characteristic CA to avoid the sound signal SA affecting the sound signals SB and SC. The regulation unit 170 can regulate different characteristics of the sound signal to fit user's needs. For example, the regulation unit 170 can change sound volume, perform EQ adjustment with respect to a particular frequency or change the style of the sound signal.

The regulating method and the audio processing device using the same disclosed in above embodiments of the present invention can obtain the sound signal characteristic CA of the sound source A using the beamforming technique, the sound rotation technique and the end fire array technique to regulate the sound source A of the designated object PA.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An audio processing device used to regulate a sound source of a designated object, wherein the audio processing device comprises:

a signal reception unit used to receive an original two-channel signal;

an angle detection unit used to detect an included angle of the designated object with respect to an ear of a user;

a beamforming unit used to form a first beam and a second beam in a clockwise direction and a counterclockwise direction respectively according to the included angle to obtain a bidirectional sound signal;

a rotation unit used to perform a sound rotation process, so that the ear is directed toward the sound source of the designated object, and a rotated two-channel sound signal is obtained;

an end fire array used to obtain a unidirectional sound signal towards the sound source of the designated object, wherein the unidirectional sound signal contains a noise;

a signal processing unit used to obtain a sound signal characteristic of the sound source of the designated object according to the bidirectional sound signal and the unidirectional sound signal; and a regulation unit used to regulate the sound signal characteristic of the sound source of the designated object to synthesize a regulated two-channel signal.

2. The audio processing device according to claim 1, wherein the first beam has a width identical to that of the second beam.

3. The audio processing device according to claim 1, wherein the sound source of the rotated two-channel sound signal has a quantity identical to that of the sound source of the original two-channel sound signal.

4. The audio processing device according to claim 1, wherein the end fire array forms a third beam to obtain the unidirectional sound signal towards the sound source of the designated object.

5. The audio processing device according to claim 4, wherein the third beam has a width greater than that of the first beam.

6. The audio processing device according to claim 4, wherein the third beam has a width greater than that of the second beam.

7. The audio processing device according to claim 1, wherein the signal processing unit takes intersection of the bidirectional sound signal and the unidirectional sound signal to obtain the sound signal characteristic of the designated object.

8. The audio processing device according to claim 1, wherein the regulation unit regulates a phase of the sound signal characteristic of the designated object.

9. The audio processing device according to claim 1, wherein the regulation unit regulates an amplitude of the sound signal characteristic of the designated object.

10. The audio processing device according to claim 1, wherein the angle detection unit obtains a position of the designated object on a display and an orientation of a head using an image recognition technique to obtain the included angle.

11. A method for regulating a sound source of a designated object, comprising:

obtaining an original two-channel signal;

detecting an included angle of the designated object with respect to an ear of a user;

forming a first beam and a second beam in a clockwise direction and a counterclockwise direction according to the included angle to obtain a bidirectional sound signal;

performing a sound rotation process, so that the ear is directed toward the sound source of the designated object, and a rotated two-channel sound signal is obtained;

obtaining a unidirectional sound signal towards the sound source of the designated object, wherein the unidirectional sound signal contains a noise;

obtaining a sound signal characteristic of the sound source of the designated object according to the bidirectional sound signal and the unidirectional sound signal; and regulating the sound signal characteristic of the sound source of the designated object to synthesize a regulated two-channel signal.

12. The method according to claim 11, wherein the first beam has a width identical to that of the second beam.

13. The method according to claim 11, wherein the sound source of the rotated two-channel sound signal has a quantity identical to that of the sound source of the original two-channel sound signal.

14. The method according to claim 11, wherein the end fire array forms a third beam to obtain the unidirectional sound signal towards the sound source of the designated object.

15. The method according to claim 14, wherein the third beam has a width greater than that of the first beam.

16. The method according to claim 14, wherein the third beam has a width greater than that of the second beam.

17. The method according to claim 11, wherein intersection of the bidirectional sound signal and the unidirectional sound signal are taken to obtain the sound signal characteristic of the designated object.

18. The method according to claim 11, wherein a phase of the sound signal characteristic of the designated object is regulated.

19. The method according to claim 11, wherein an amplitude of the sound signal characteristic of the designated object is regulated.

20. The method according to claim 11, wherein a position of the designated object on a display and an orientation of a head using an image recognition technique are obtained to obtain the included angle.

* * * * *